United States Patent [19]

Albaugh

[11] Patent Number: 4,534,677

[45] Date of Patent: Aug. 13, 1985

[54] SECONDARY CAPPING BEAMS FOR OFFSHORE DRILLING PLATFORMS

[75] Inventor: Edward K. Albaugh, Houston, Tex.

[73] Assignee: Dolphin Titan International, Inc., Houston, Tex.

[21] Appl. No.: 577,265

[22] Filed: Feb. 6, 1984

[51] Int. Cl.[3] ..... E02D 21/00

[52] U.S. Cl. ..... 405/203; 405/195

[58] Field of Search ..... 405/195–209, 405/224; 175/5, 7

[56] References Cited

U.S. PATENT DOCUMENTS

| | | | |
|---|---|---|---|
| 3,001,592 | 9/1961 | Lucas | 405/201 X |
| 3,033,525 | 5/1962 | Johnson | 405/201 X |
| 3,244,242 | 4/1966 | Wolff | 405/201 X |
| 3,364,684 | 1/1968 | Sandberg | 405/204 |
| 3,433,024 | 3/1969 | Diamond et al. | 405/205 X |
| 3,477,235 | 11/1969 | Branham et al. | 405/203 X |
| 4,224,005 | 9/1980 | Dysarz | 405/209 X |
| 4,445,805 | 5/1984 | Ray et al. | 405/195 X |

*Primary Examiner*—Dennis L. Taylor

*Attorney, Agent, or Firm*—Guy E. Matthews

[57] ABSTRACT

A pair of I-shaped elongated girders secured to, and extending outwardly from, the capping beams of a four pile platform, to form cantilever secondary capping beams which support modified self-contained drilling rigs of a size and weight normally installed on eight pile platforms. Rig modifications comprise separation of pump and engine packages, a pipe rack extension, and a novel skidding system.

7 Claims, 7 Drawing Figures

SECONDARY CAPPING BEAMS FOR OFFSHORE DRILLING PLATFORMS

BACKGROUND OF THE INVENTION

This invention relates to offshore drilling platform structures, and more particularly to secondary capping beams which are secured to, and extend outwardly from, the capping beams of a four pile platform to support modified self-contained drilling rigs of a size and weight normally installed on eight pile platforms.

BRIEF DESCRIPTION OF THE PRIOR ART

Traditionally tender-type platform rigs have been favored for developmental drilling in some offshore areas such as the Gulf of Mexico. In recent years the number of drilling tender-type rigs operating in this area has declined. Many companies have had to rely upon jack-up and self-contained platform rigs. Availability of deepwater, cantilever jack-up rigs is limited and, consequently, self-contained platform rigs are generally selected for use in water depths beyond 250 feet. When multiple wells and associated production equipment are contemplated, an eight pile platform is preferred to accommodate the size and weight of the rig, and to provide space for production equipment.

Secondary capping beams derive their name from being positioned atop the platform capping beams. The term "capping beam" refers to the primary structural member upon which the drilling rig skids.

The present secondary capping beam structure allows a rig designed for use with an eight pile platform to be adapted to a four pile platform configuration. Previously, a special class of self-contained platform rigs was designed and built to fit these minimum deck area platforms.

SUMMARY OF THE INVENTION

It is therefore an object of the present invention to provide a support means for installing self-contained platform drilling rigs on four column satellite drilling platforms having restricted deck area.

Another object of this invention is to provide a support means whereby a full size rig may be installed on a small platform, thereby reducing installation and fabrication costs.

Another object of this invention is to provide a support means whereby the drilling rig may be located over half of the platform main deck to provide space for production quarters and equipment storage.

Other objects of the invention will become apparent from time to time throughout the specification and claims as hereinafter related.

The above-noted objects and other objects of the invention are accomplished by cantilever secondary capping beams which are secured to, and extending outwardly from, the capping beams of a four pile platform to support modified self-contained drilling rigs of a size and weight normally installed on eight pile platforms. Rig modifications comprise separation of pump and engine packages, a pipe rack extension, and a novel skidding system.

DESCRIPTION OF THE PREFERRED EMBODIMENT

Figure 1:
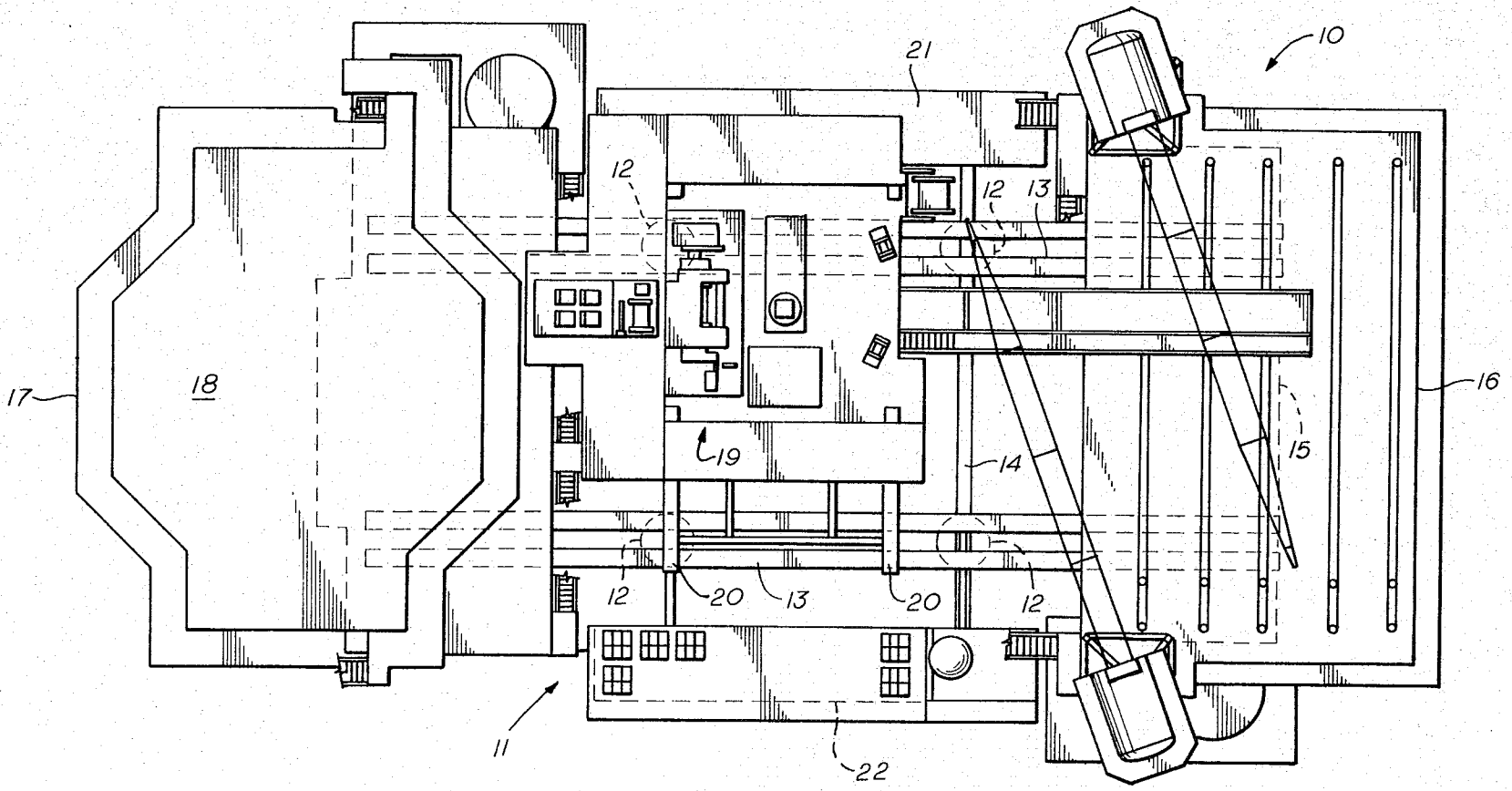
FIG. 1 is a top elevational view of an offshore drilling platform having secondary capping beams installed thereon.
Figure 2:
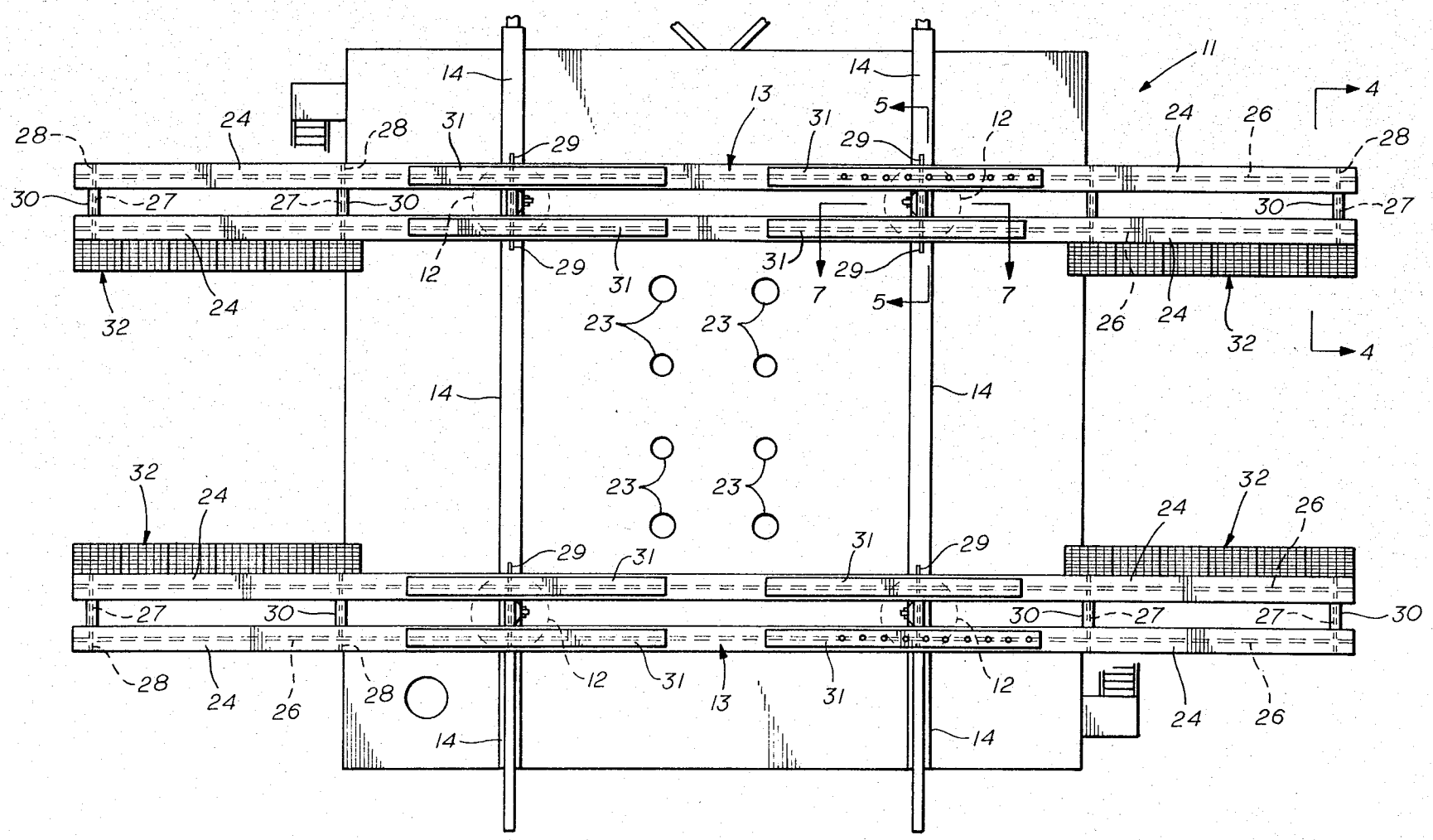
FIG. 2 is a top elevational view of an offshore drilling platform deck showing secondary capping beams installed thereoon and portions of the deck structure removed.
Figure 3:
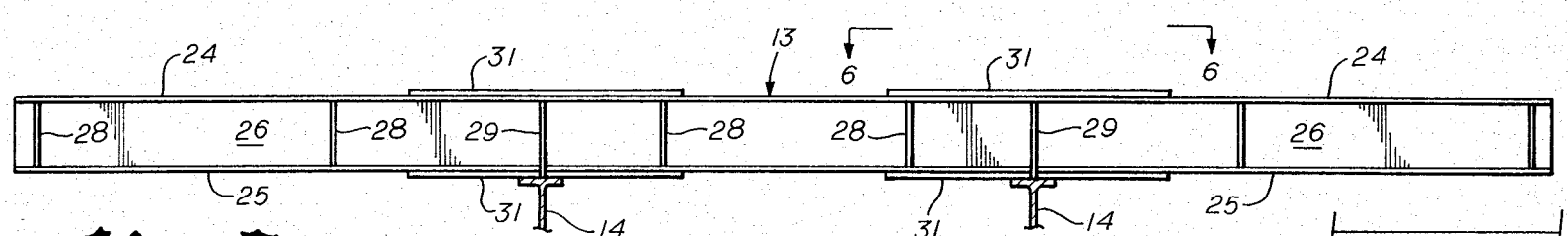
FIG. 3 is a side elevational view of one of the secondary capping beams in accordance with the present invention.

Referring now to the drawings by numerals of reference, and particularly to FIGS. 1 and 2, there is shown a self-contained drilling rig 10 mounted on a four pile platform 11. The four platform columns or piles 12 are represented by dashed lines.

The cantilever secondary capping beams 13 are secured to the top of the platform capping beams 14. The pump package 15, together with the pipe rack deck 16, is supported over the water on one end of the secondary capping beams 13. The engine package 17 and main quarters package 18 are cantelivered on the other end of the beams 13. The substructure 19 is mounted on the skid base 20 between the packages. Center wing deck areas on the main deck of the platform between the pump package 15 and the engine package 17 provide space for locating combination tank and mud processing packages 21 and 22, respectively.

The combination tank package 21, which stores drilling and potable water and diesel fuel, is designed to span forty or forty-five feet distances. The arrangement of equipment permits the tank package 21 to mount directly on top of the platform capping beams 14, which are on forty foot centers. Live and dead static loads for the tank package 21 result in concentrated loads that are directly transferred into the main structural framing of the deck.

Movement of the skid base 20 over the well pattern 23 is such that all drilling loads and dead loads associated with the substructure 19 are contained within the forty by forty foot pattern of platform piles 12. Therefore, any major dynamic loads due to drilling are directly transmitted into the platform columns.

Referring now to FIGS. 2, 3, 4 and 5, the secondary capping beams 13 comprise paired elongated I-shaped girders preferably 124 feet long and 7 feet tall spaced apart on 5 foot centers. Each beam weighs approximately 110 tons. The 5 foot spacing provides torsional strength, and acts to increase the moment of inertia about the vertical axis because of lateral wind loads. The spacing also facilitates reaction load transfer through existing column and diagonal members of pump and engine package structural framing, and it simplifies fabrication by allowing welder access between the beams.

Each beam 13 is constructed of a top flange 24 and a bottom flange 25 formed from 2 inch thick by 30 inch wide steel plate and has a 1 inch thick longitudinal web portion 26. The web portions 26 are joined by a series of vertical, 1 inch thick longitudinally spaced transverse crossmembers 27 welded therebetween and extending between the flanges 24 and 26.

A series of 1 inch thick rectangular gusset plates 28 in axial alignment with the crossmembers 27 extend outwardly from the web portion 26 and extend vertically between the flanges 24 and 25. Vertical, 1 inch thick angular gusset plates or stiffeners 29 extend outwardly from the web portion 26 at the point where the beams 13 rest on the platform beam 14. The bottoms of the angular stiffener plates 29 extend beyond the bottom flange 25 to be welded to the top flange of the platform beam 14.

A series of 12 inch wide and 1 inch thick horizontal crossmembers 30 at the top and bottom of the transverse crossmembers 27 extend between the top and bottom flanges 24 and 25 and are welded to the crossmembers 27 and the flanges 24 and 25.

Cover plates 31 are welded to the outer surface of the top and bottom of the flanges 24 and 25 to increase bending strength of the beams 13 over the platform deck support points. The cover plates 31 are located on the beams 13 at the areas of maximum bending moment stress.

Walkways 32 are provided at each end of the inboard secondary capping beams 13 and extend longitudinally inward therefrom a distance of 30 feet. The walkways 32 comprise a structural steel frame 33 welded to the bottom flanges 25 and the web portion 26. A handrail 34 is welded to the frame 33 and extends vertically upward therefrom. A galvanized bar grating 35 welded to the frame 33 forms the floor of the walkway 32.

Figure 6:
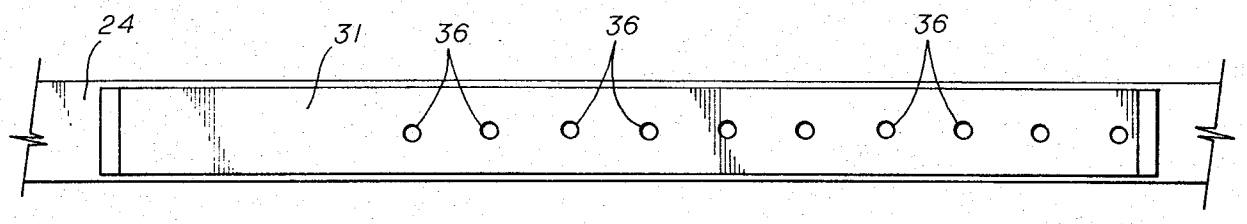
FIG. 6 is a top elevational view of a cover plate of a secondary capping beam.
Figure 4:
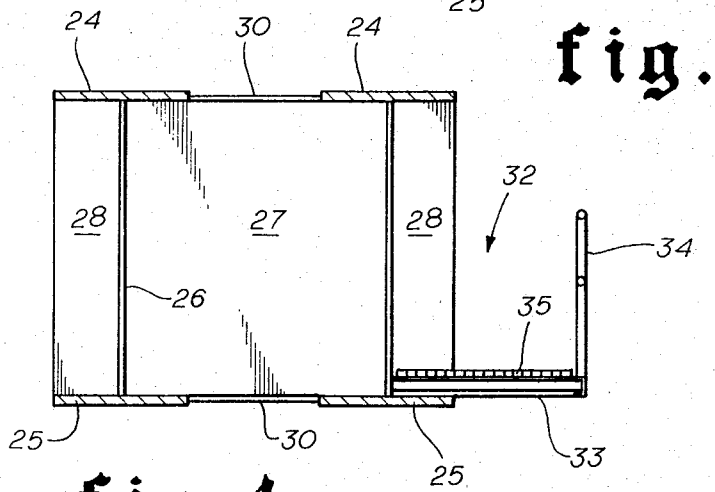
FIG. 4 is a cross-sectional view of a portion of a secondary capping beam taken along the line 4—4 of FIG. 2.

Since the top flanges 24 of the secondary capping beams become the new skidding surface, two of the outboard cover plates 31 as shown in FIG. 6 are provided with a series of longitudinally spaced apart jacking holes 36. Because the holes 36 are located in the area of greatest tensile stress on the beams, circular holes preferably 5 inches in diameter rather than conventional rectangular jacking holes are used to reduce stress concentration.

Figure 7:
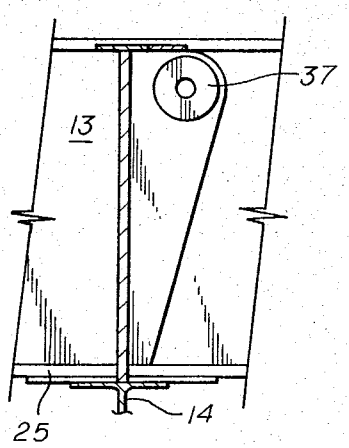
FIG. 7 is a cross-sectional side elevation view taken along line 7—7 of the secondary capping beam of FIG. 2 showing the lifting means.
Figure 5:
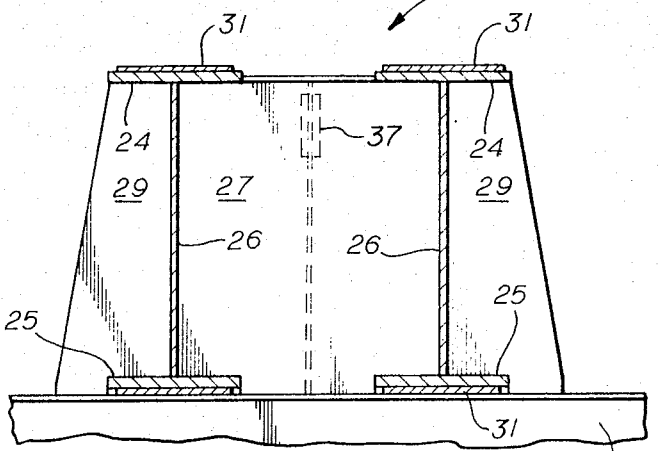
FIG. 5 is a cross-sectional view of a portion of a secondary capping beam taken along the line 5—5 of FIG. 2.

The secondary capping beams 13 are designed to be fabricated onshore where the welds may be ultrasonically inspected and transported to the platform site. Two opposing lift eyes 37 as shown in FIGS. 5 and 7 provide a means for hoisting the beams 13 into position by cranes.

The secondary capping beams in accordance with the present invention are designed to handle 1.5 million pounds cantilevered on both ends simultaneously with only a 40 foot span distance between the center support points. Beams cantilever 42 feet out over the water. Beams can also be placed on decks with 45 by 45 foot column row spacing, and with this spacing, cantilever distances are reduced along with associated stresses.

While this invention has been described fully and completely with special emphasis upon a preferred embodiment, it should be understood that within the scope of the appended claims the invention may be practiced otherwise than is specifically described herein.

What is claimed is:

1. A cantilever support means having a pair of secondary capping beams, and being secured to an existing drilling platform structure and extending therebeyond for supporting modified, self-contained drilling rigs, said existing drilling platform structure comprising, a platform structure secured to four main supporting columns, said modified self-contained drilling rigs being of sufficient size and weight to accommodate drilling and associated production equipment for drilling multiple wells, said modified drilling rig further comprising, a pump package and a pipe rack deck supported on one extended end of the secondary capping beams, an engine package and main quarters package cantilevered on the opposed extended end of said secondary capping beams, combination tank and mud processing packages disposed on center wing deck areas on the main deck of said platform between said pump package and engine package, and a drilling substructure mounted on a skid base between said packages.

2. The support means according to claim 1, wherein said support means further comprises two opposing lift eyes to provide a means for hoisting said secondary capping beams into position on said platform.

3. The support means according to claim 2 wherein said support means further comprises walkways provided at each end of the inboard of said secondary capping beams, said walkways being secured thereto and extending longitudinally inward therefrom, and a handrail secured to said walkway and extending vertically upward therefrom.

4. The support means according to claim 3, wherein said secondary capping beams comprise two paired longitudinally elongated I-shaped girders laterally spaced apart.

5. The support means according to claim 4, wherein each of said I-shaped girders comprises:

a top flange and a bottom flange, a central vertical web portion secured thereto and extending longitudinally therebetween, a series of vertical longitudinally spaced apart transverse crossmembers interposed between said web portions and said flanges and secured thereto, a series of horizontal rectangular crossmembers centrally disposed at the top and bottom of said transverse crossmembers between said top and bottom flanges and secured thereto, a series of rectangular gusset plates in axial alignment with said crossmembers extending outwardly from said web portions and vertically between said flanges and secured thereto, and stiffener plates extending vertically between said top and bottom flanges and outwardly from said web portions secured thereto and disposed at the point where said secondary capping beams rest on said platform capping beams, said stiffener plates having an extended bottom portion for securing said secondary capping beams to the top surface of said platform capping beams.

6. The support means according to claim 5, wherein such support means further comprises rectangular cover plates secured to the outer surface of said top and bottom flanges at the areas of maximum bending moment stress to increase bending strength of said secondary capping beams and to provide a skid surface.

7. The support means according to claim 6, wherein one or more of said cover plates are provided with a series of longitudinally spaced apart circular holes for jacking operations and to reduce stress concentration.

* * * * *